US011598059B2

(12) United States Patent
Palus et al.

(10) Patent No.: US 11,598,059 B2
(45) Date of Patent: Mar. 7, 2023

(54) GATE SAFETY BARRIER ASSEMBLY

(71) Applicant: MULTI-FAB PRODUCTS, LLC, Menomonee Falls, WI (US)

(72) Inventors: Thomas Palus, Menomonee Falls, WI (US); Todd Mervin, Menomonee Falls, WI (US); Sunil Kalavathi, Menomonee Falls, WI (US); Robert J. Hensel, Germantown, WI (US)

(73) Assignee: MULTI-FAB PRODUCTS, LLC, Menomonee Falls, WI (US)

( * ) Notice: Subject to any disclaimer, the term of this patent is extended or adjusted under 35 U.S.C. 154(b) by 190 days.

(21) Appl. No.: 17/153,422

(22) Filed: Jan. 20, 2021

(65) Prior Publication Data

US 2022/0074149 A1 Mar. 10, 2022

Related U.S. Application Data

(60) Provisional application No. 63/076,224, filed on Sep. 9, 2020.

(51) Int. Cl.
*E01F 13/02* (2006.01)
*E01F 13/06* (2006.01)

(52) U.S. Cl.
CPC ..... *E01F 13/024* (2013.01); *E01F 13/06* (2013.01)

(58) Field of Classification Search
CPC ..... E01F 13/00; E01F 13/024; E01F 13/06
See application file for complete search history.

(56) References Cited

U.S. PATENT DOCUMENTS 4,150,510 A 4/1979 Harrison et al.
5,001,862 A * 3/1991 Albenda ..... E06B 7/367 49/383
5,271,183 A 12/1993 Hahn et al.
5,299,386 A 4/1994 Naegelli et al.
5,459,963 A * 10/1995 Alexander ..... E01F 1/00 49/34
5,564,238 A 10/1996 Ellis
5,829,505 A 11/1998 Brescia
6,212,825 B1 * 4/2001 Hopkins, Jr. ..... E01F 13/06 49/358
6,485,224 B1 * 11/2002 Dyke ..... E01F 15/12 404/6
7,739,834 B2 * 6/2010 Stoffels ..... E01F 13/06 49/233

(Continued)

*Primary Examiner* — Abigail A Risic
(74) *Attorney, Agent, or Firm* — Erin Ella Block; DeWitt LLP

(57) ABSTRACT

A gate safety barrier system is provided for use at a loading dock to prevent accidental or inadvertent movement of a loading dock vehicle and/or personnel through an access passageway provided on the loading dock. The gate safety barrier includes a pair of bollards positioned on opposite sides of the passageway and a horizontal center member pivotally mounted on pivot bollard. The horizontal center member includes two sections connected together by means of a center hinge. The horizontal center member moves to close and block the passageway. When in the closed position the horizontal center member spans the distance between the bollards. The system provides safety, ease of use, and improved functionality which protect personnel while the assembly is being moved between closed blocked passageway to open unblocked passageway.

20 Claims, 15 Drawing Sheets

(56) References Cited

Figure 1A:
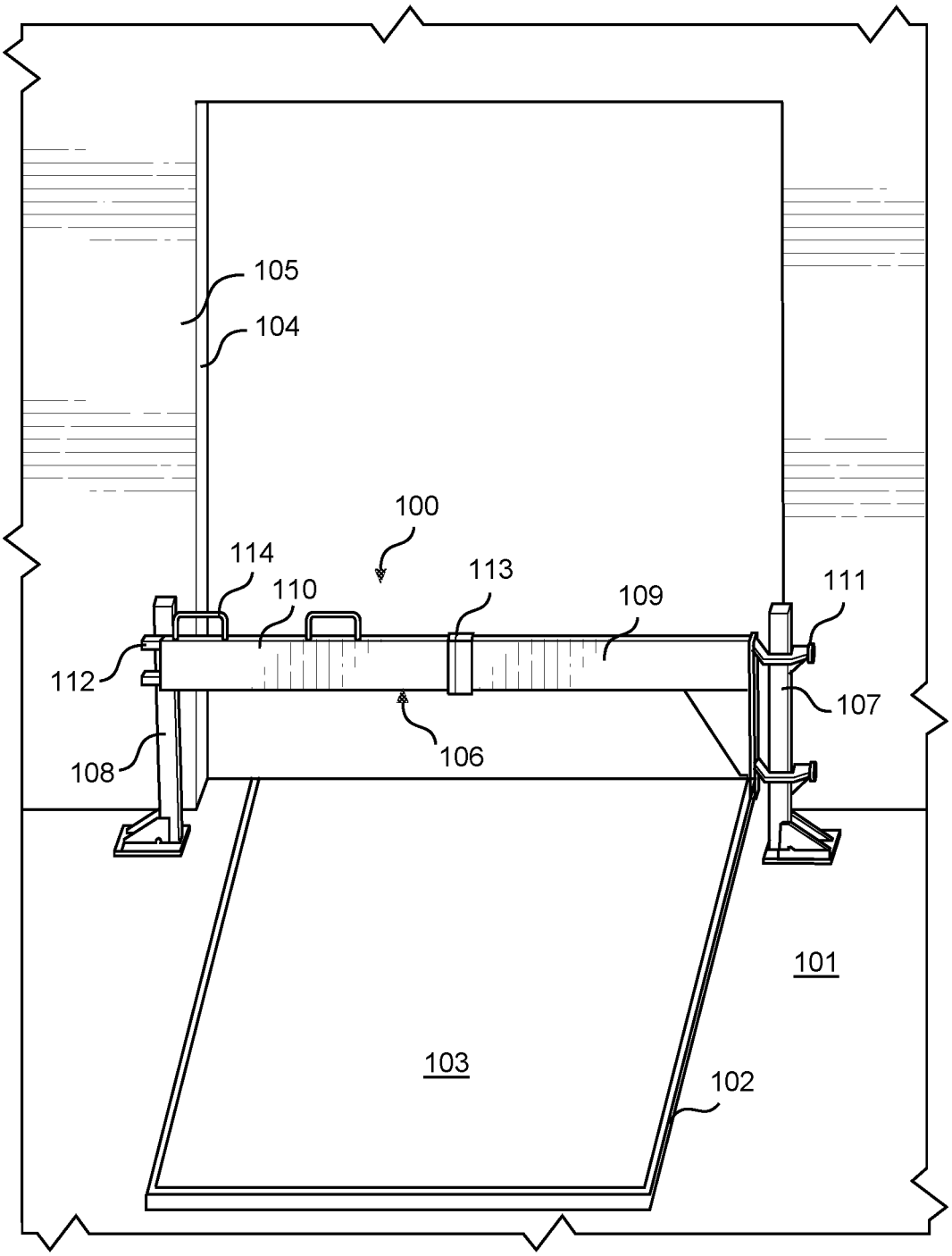

U.S. PATENT DOCUMENTS 7,832,451 B2 11/2010 Miller et al.
8,490,668 B2 7/2013 Snyder et al.
8,826,963 B2 9/2014 Wiegel et al.
9,181,749 B1 * 11/2015 Davis ..... E06B 7/36
9,217,229 B2 12/2015 Ball
9,540,867 B2 1/2017 Pilgrim et al.
9,593,454 B2 * 3/2017 Bürgin ..... E01F 13/06
D867,617 S * 11/2019 Galla ..... D25/48.5
D867,618 S 11/2019 Galla
D867,619 S 11/2019 Galla
10,907,314 B2 * 2/2021 Satrom ..... E05F 1/10
11,248,417 B2 * 2/2022 Brinkman ..... E01F 13/06
11,427,385 B1 * 8/2022 Cutter ..... B65D 25/102
2002/0152683 A1 * 10/2002 Burnette ..... E01F 13/06 49/49
2004/0154129 A1 * 8/2004 Martinez-Munoz ..... E05D 11/0054 16/250
2008/0127557 A1 * 6/2008 Bongard ..... E01F 13/06 49/49
2013/0133264 A1 * 5/2013 Melkes ..... E01F 13/06 49/49
2014/0183431 A1 * 7/2014 Robinson ..... E04H 17/163 256/24
2015/0107052 A1 * 4/2015 Talpe ..... E05D 11/0018 29/402.03
2015/0211291 A1 * 7/2015 Jaffee ..... E06B 7/367 16/250
2016/0002870 A1 * 1/2016 Younce ..... E01F 13/06 49/13
2016/0230449 A1 * 8/2016 Robertson-Sharma ..... A47D 13/00
2019/0300302 A1 * 10/2019 Yule ..... B65G 69/003
2020/0173190 A1 * 6/2020 Galla ..... E01F 13/028
2020/0284079 A1 * 9/2020 Prodromou ..... E05D 9/005
2020/0291721 A1 * 9/2020 Brinkman ..... E06B 11/022
2021/0123197 A1 * 4/2021 Matthews ..... E06B 11/027

* cited by examiner

GATE SAFETY BARRIER ASSEMBLY

CROSS-REFERENCE TO RELATED APPLICATIONS

This application claims the benefit of prior-filed, U.S. Provisional Patent Application No. 63/076,224, filed on Sep. 9, 2020, the contents of which are incorporated herein by reference in their entirety.

BACKGROUND OF THE INVENTION

The present disclosure is directed to a loading dock system, and more specifically to a system for providing increased safety and efficiency in a loading dock gate safety barrier.

One of the primary concerns for manufacturing and warehousing personnel is personnel and material safety and protection when using motorized goods-handling devices, such as forklifts, hoists, lift trucks, and other motorized handlers. Because sight lines of lift drivers may be limited, errors can cause material damage and injuries, some severe, to personnel. Facilities may have areas of changing elevation or high traffic as well as loading areas uneven with delivery vehicles. A driver who cannot see the changing elevation, traffic, or absence of delivery vehicles may accidentally direct their goods-handling devices into a dangerous area, resulting in injury or damage. Workers may also fail to perceive dangerous areas, resulting in injury if they enter unaware.

One solution is to install security doors in front of dangerous areas. However, these doors may need to be opened for ventilation or visibility, allowing uncontrolled access to the area. Visual and audible alert devices require power sources and may not be effective for all environments. Many devices are also incapable of stopping a goods-handling device, which may only add to potential damage and injury.

There is an unmet need in the art for a safety system which does not block visibility or ventilation and is capable of withstanding impact from motorized goods-handling devices.

BRIEF SUMMARY

The present invention is a gate safety barrier system. The system includes a pivot bollard positioned on a side of a passageway opposite a latch bollard. A center member assembly is pivotally mounted to the pivot bollard such that the center member assembly is selectively movable between a closed configuration blocking the passageway and an open configuration unblocking the passageway. The center member assembly is pivotally mounted to the pivot bollard by at least one hinge pin extending through at least one hinge support bracket and at least one pin connection such that rotation of the center member assembly relative to the pivot bollard is in a horizontal plane. The hinge support bracket is connected to the pivot bollard at a 180-degree angle to a longitudinal axis of the passageway and the pin connection is connected to the center member assembly. The center member assembly includes a left member pivotally connected to a right member with a center hinge such that rotation of the left member relative to the right member is in a horizontal plane.

BRIEF DESCRIPTION OF THE DRAWING(S)

FIG. 1*a* is a front perspective view of a gate safety barrier system shown in closed configuration.

Figure 1B:
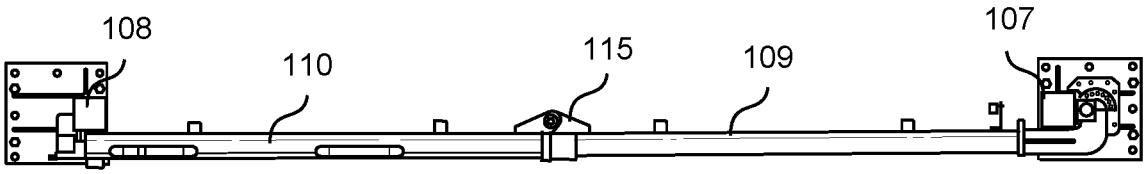

FIG. 1*b* is a top view of the gate safety barrier system in the closed configuration.

Figure 1C:
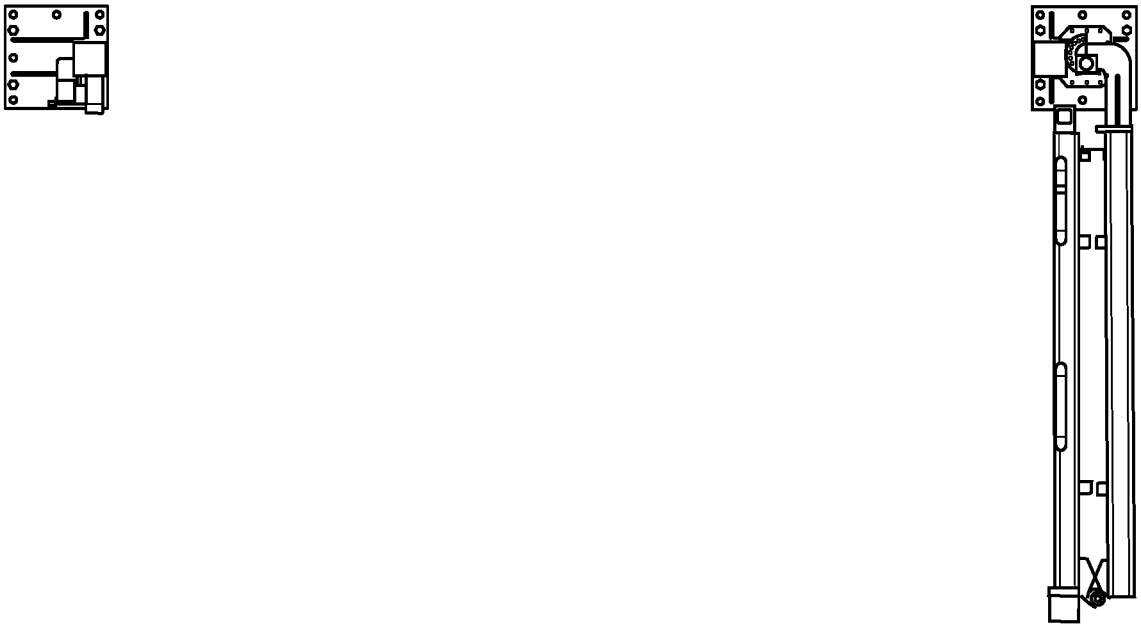

FIG. 1*c* is a top view of the gate safety barrier system in the open configuration.

Figure 1D:
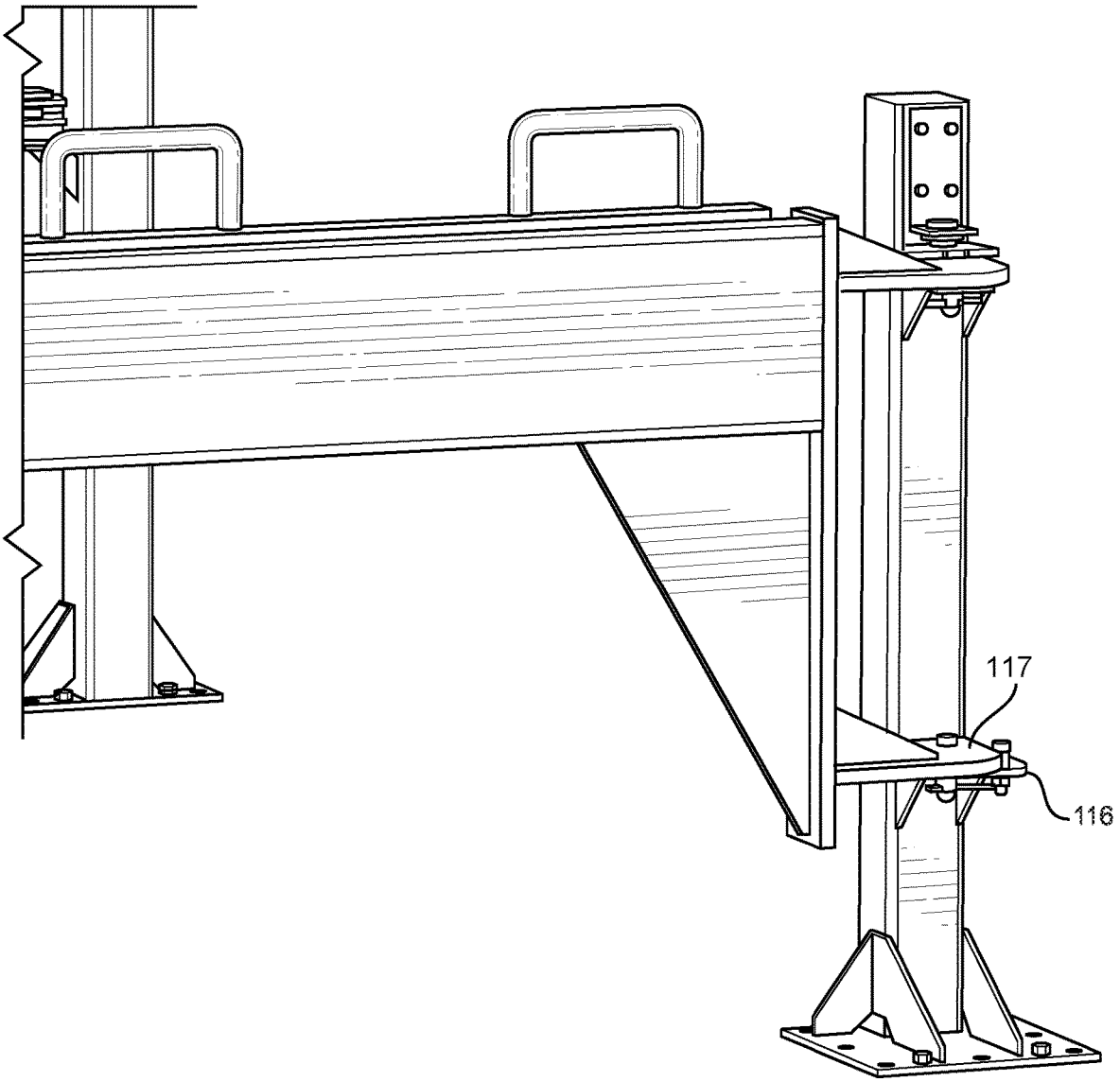

FIG. 1*d* is a fragmentary perspective view of the pivot bollard.

Figure 1E:
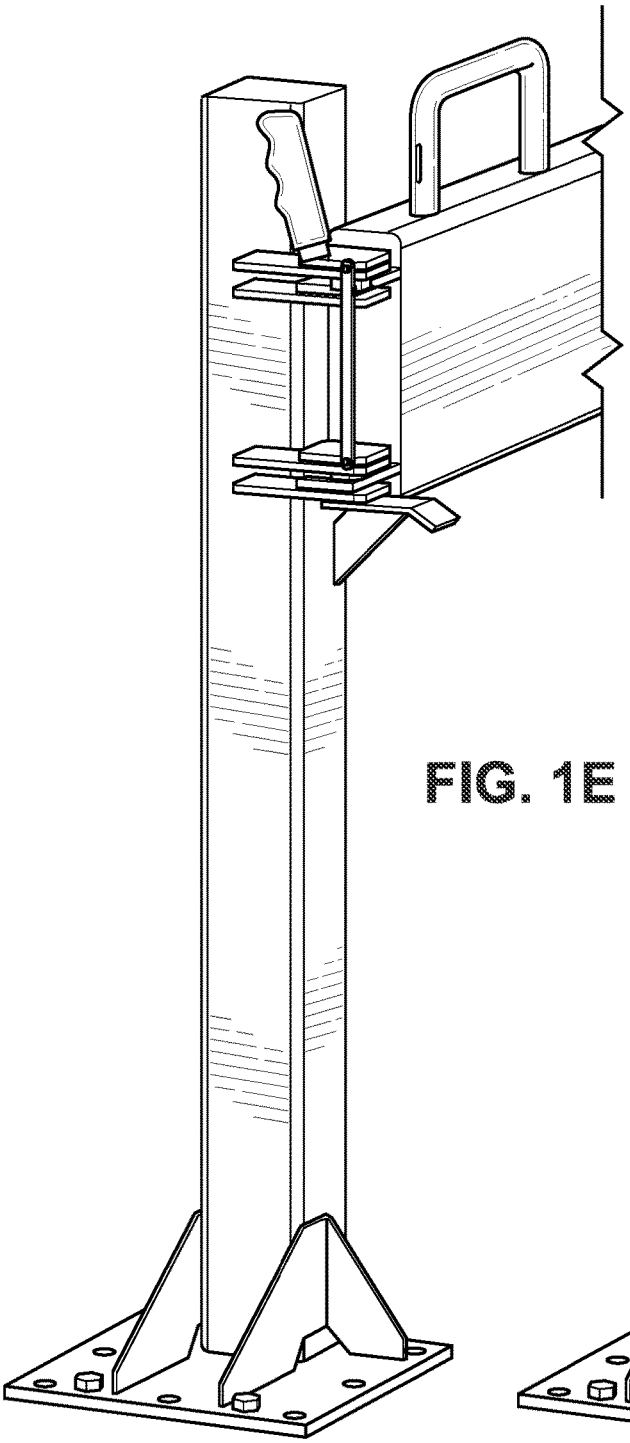

FIG. 1*e* is a fragmentary perspective view of a latch bollard with the gate safety barrier system in latched position.

Figure 1F:
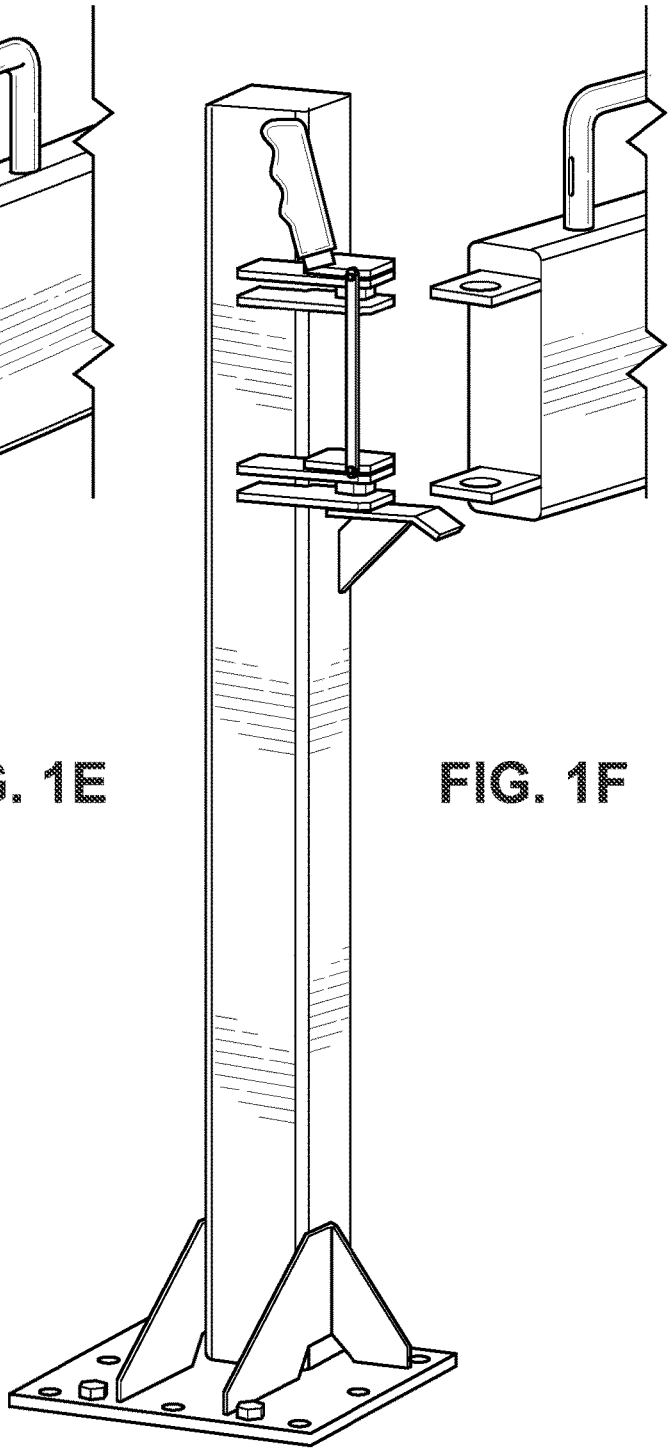

FIG. 1*f* is a fragmentary perspective view of the latch bollard with the gate safety barrier system in unlatched position.

Figure 1G:
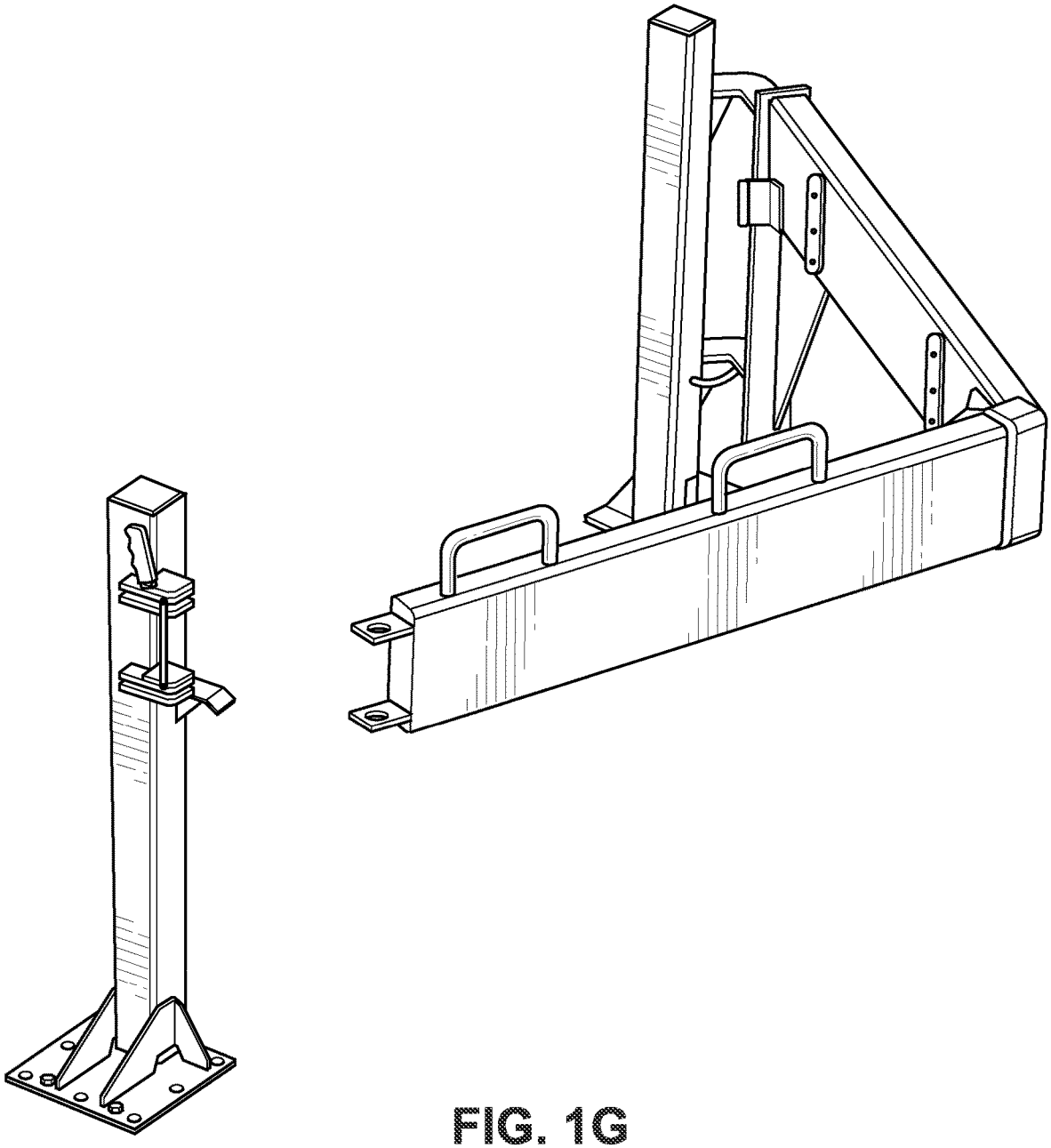

FIG. 1*g* is a perspective view of the gate safety barrier system in a partially open position.

Figure 1H:
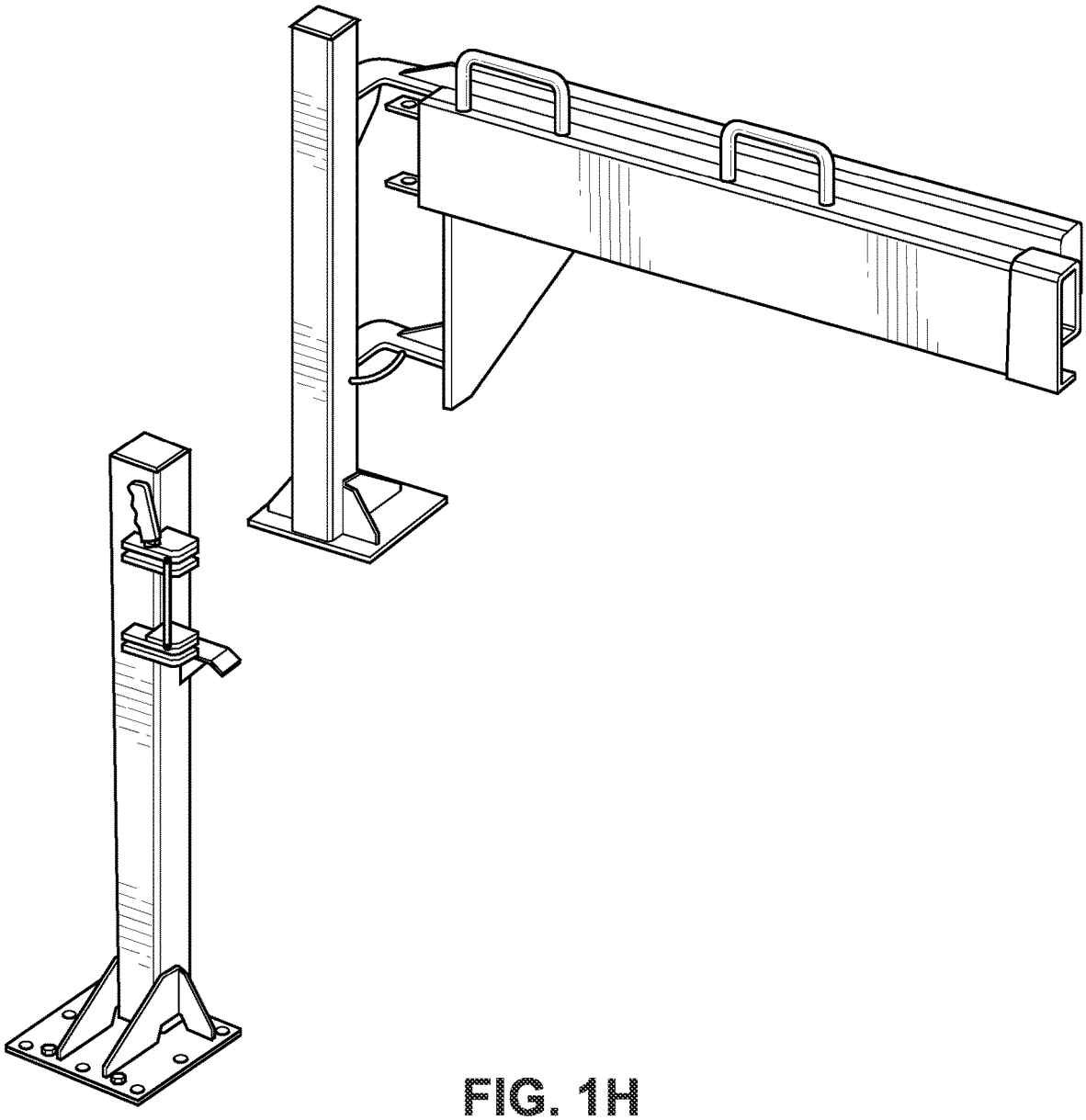

FIG. 1*h* is a perspective view of the gate safety barrier system in the open configuration.

Figure 2A:
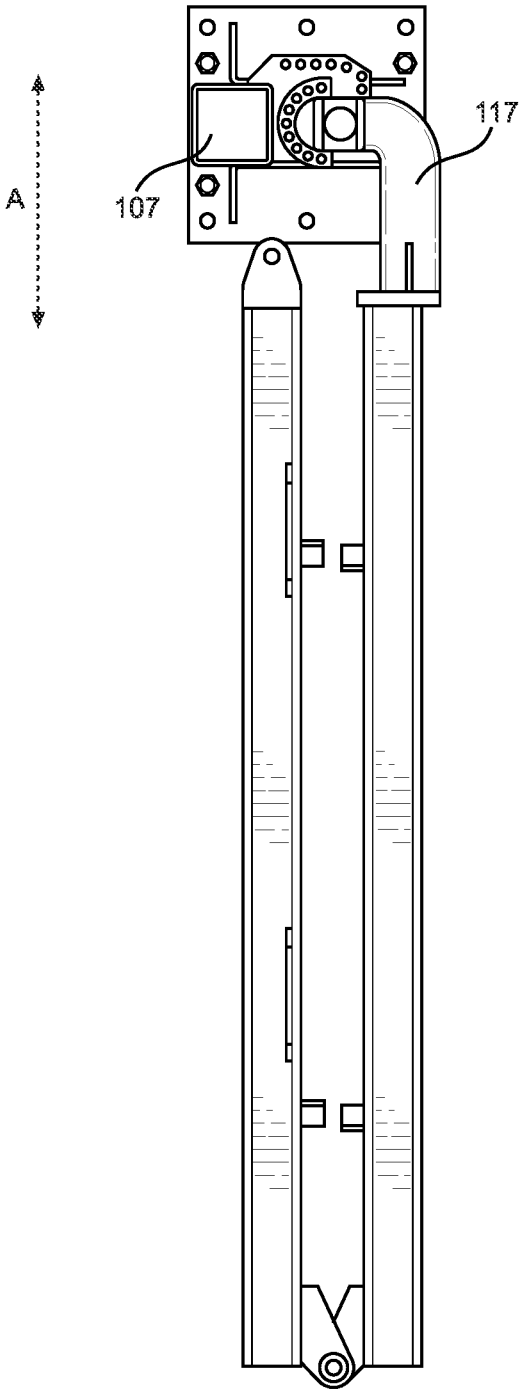

FIG. 2*a* is a top view of the gate safety barrier assembly in the open configuration.

Figure 3A:
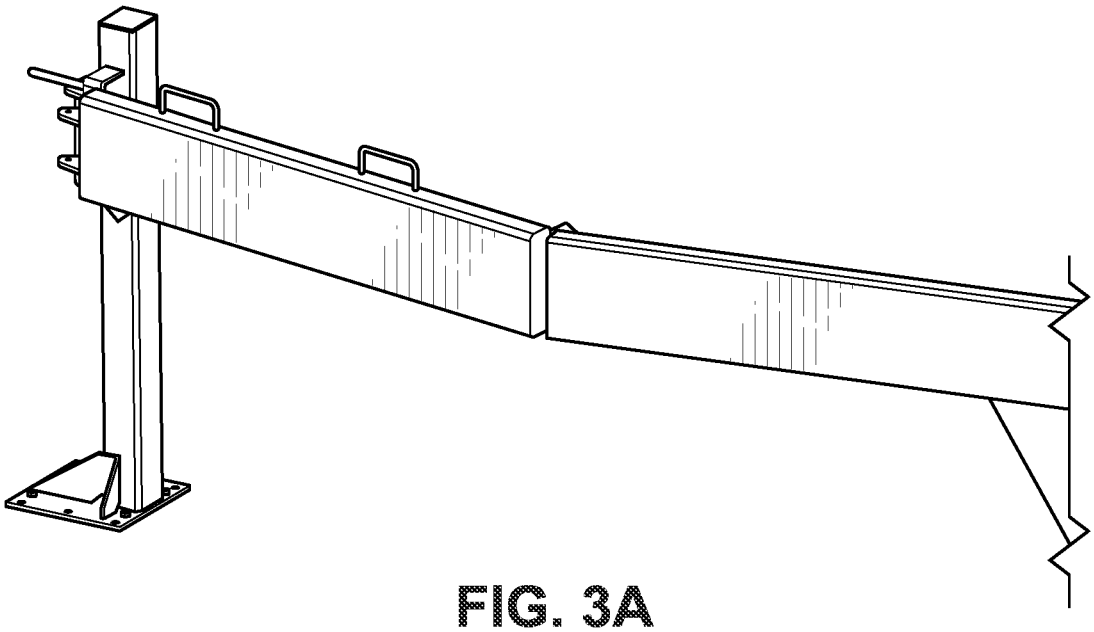
Figure 3B:
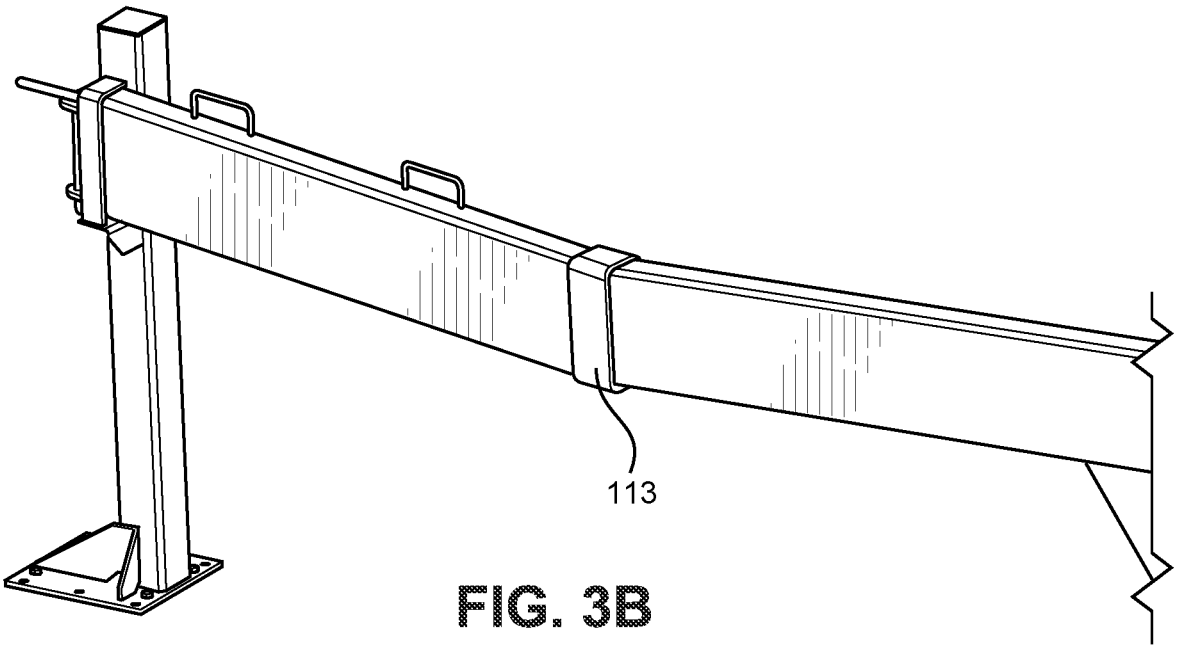

FIGS. 3*a* and 3*b* are perspective views of the gate safety barrier system in a partially open position without and with a covering, respectively.

Figure 3C:
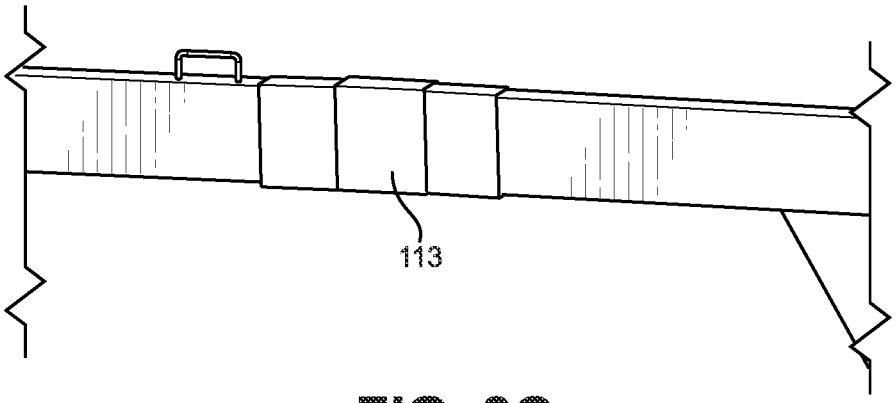
Figure 3D:
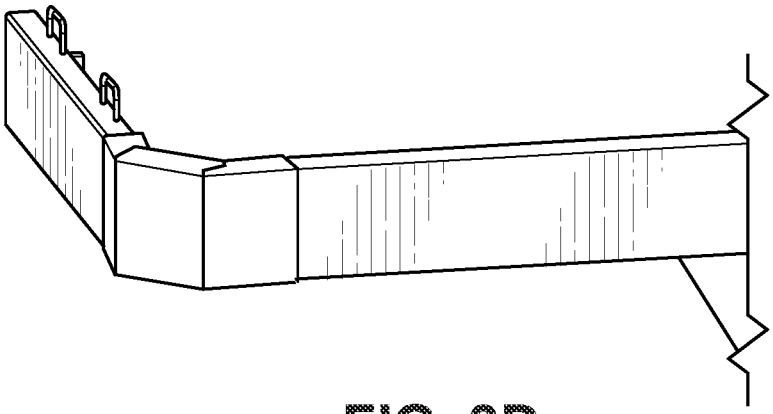
Figure 3E:
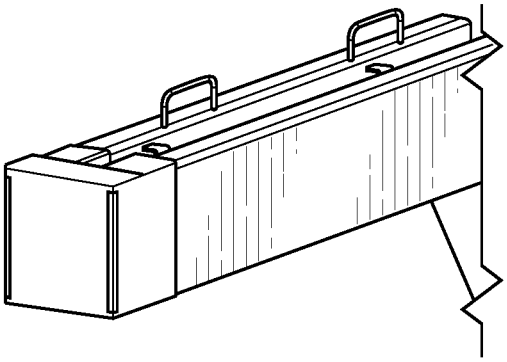

FIGS. 3*c*, 3*d*, and 3*e* are perspective views of the gate safety barrier system with a segmented covering in a closed, partially open, and open position, respectively.

Figure 4A:
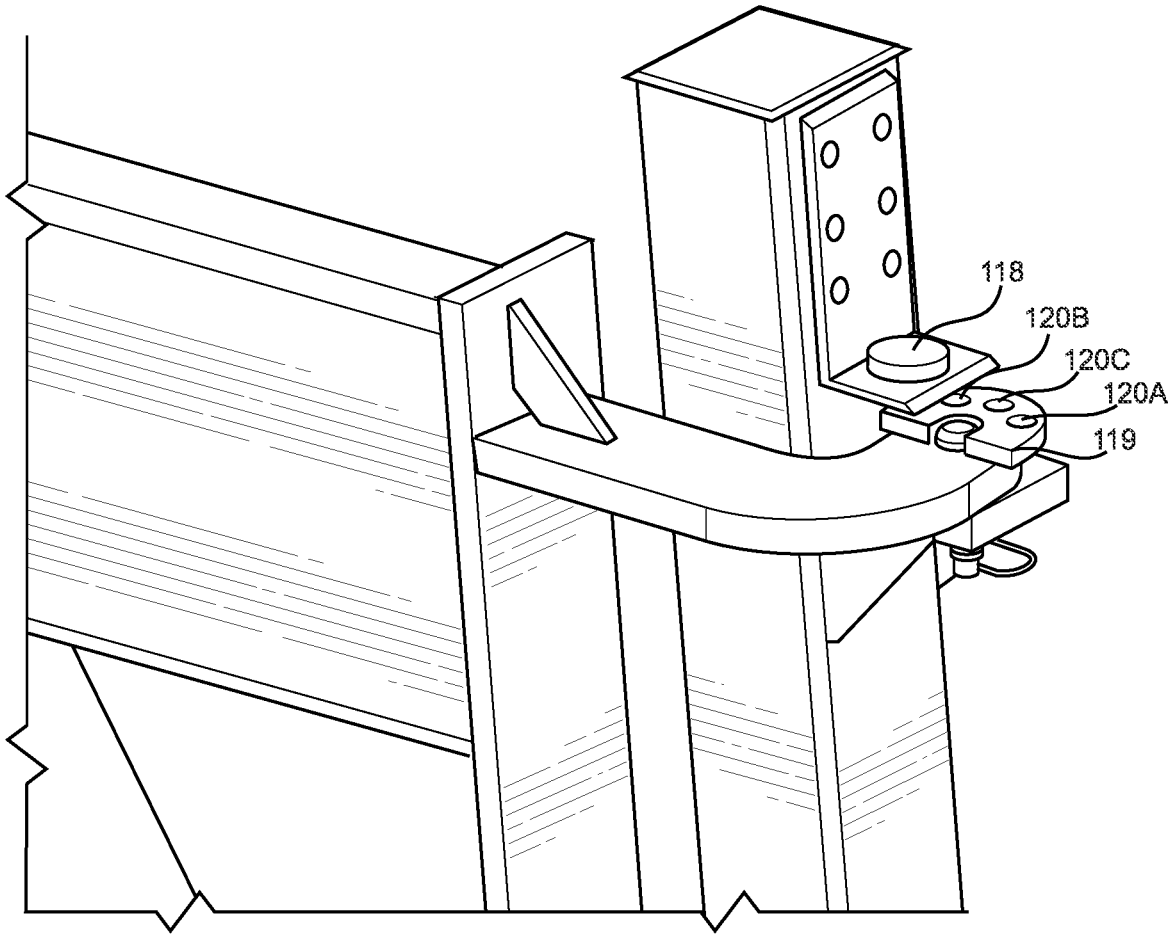

FIG. 4*a* is a partial perspective view of the gate safety barrier system showing a detent and receiving plate.

Figure 4B:
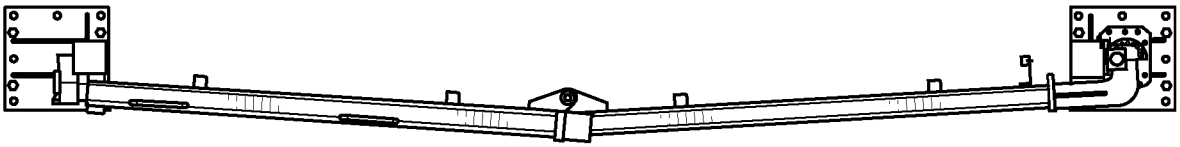
Figure 4C:
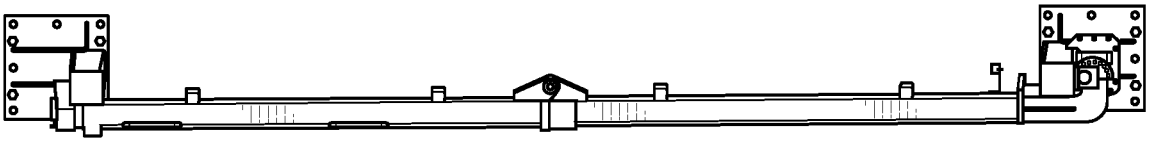

FIGS. 4*b* and 4*c* are top views of the gate safety barrier system in the closed configuration.

Figure 5A:
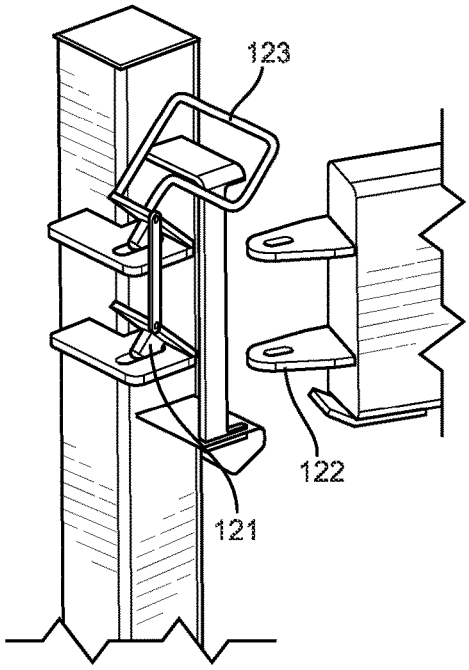
Figure 5B:
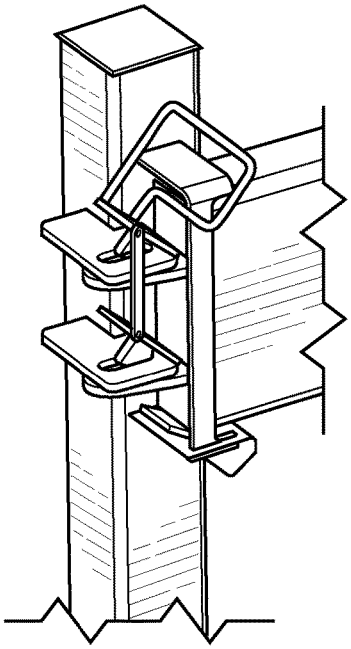
Figure 5C:
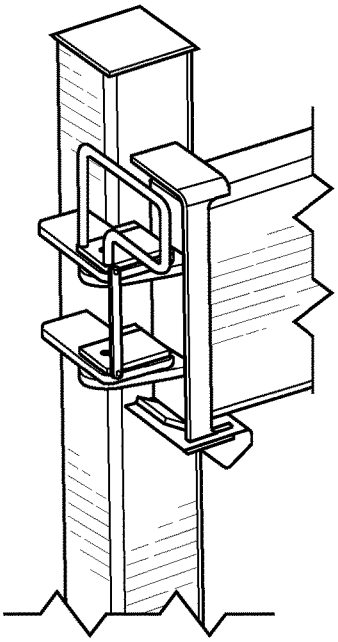

FIGS. 5*a*, 5*b*, and 5*c* are partial perspective views of the gate safety barrier system with a latch feature in an unlatched, latching, and latched configuration, respectively.

Figure 5D:
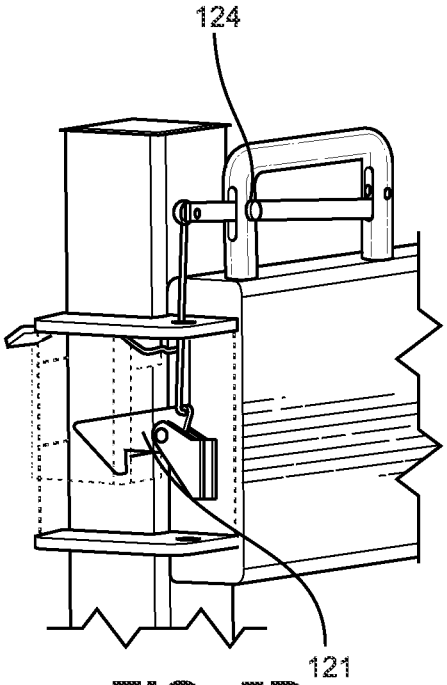
Figure 5E:
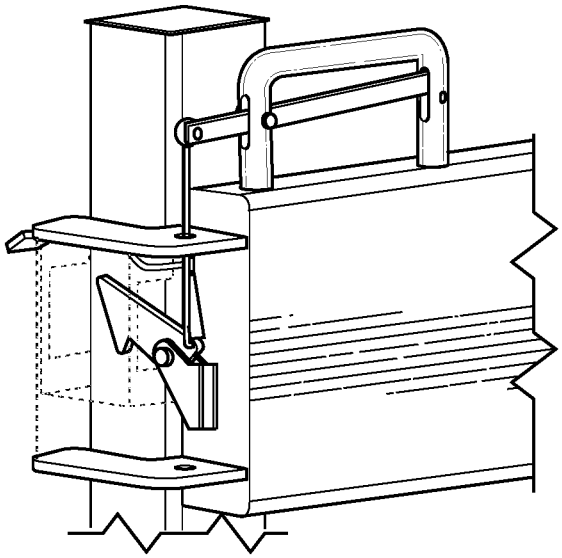
Figure 5F:
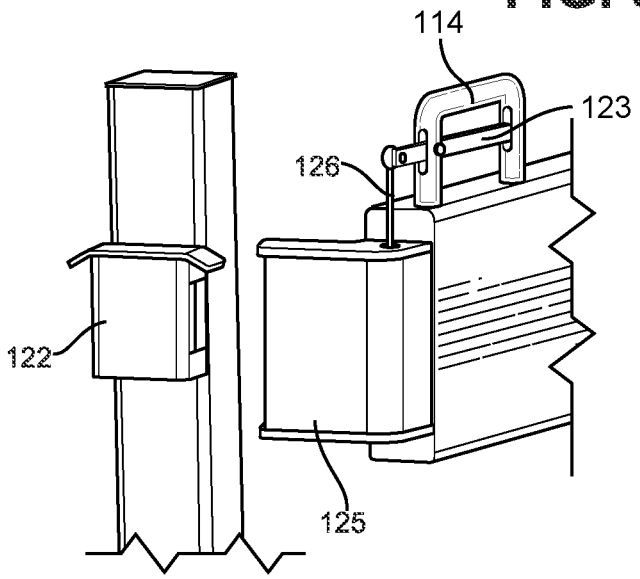

FIGS. 5*d*, 5*e*, and 5*f* are partial perspective views of the gate safety barrier system with a latch feature in a latched, unlatching, and unlatched configuration, respectively.

Figure 6A:
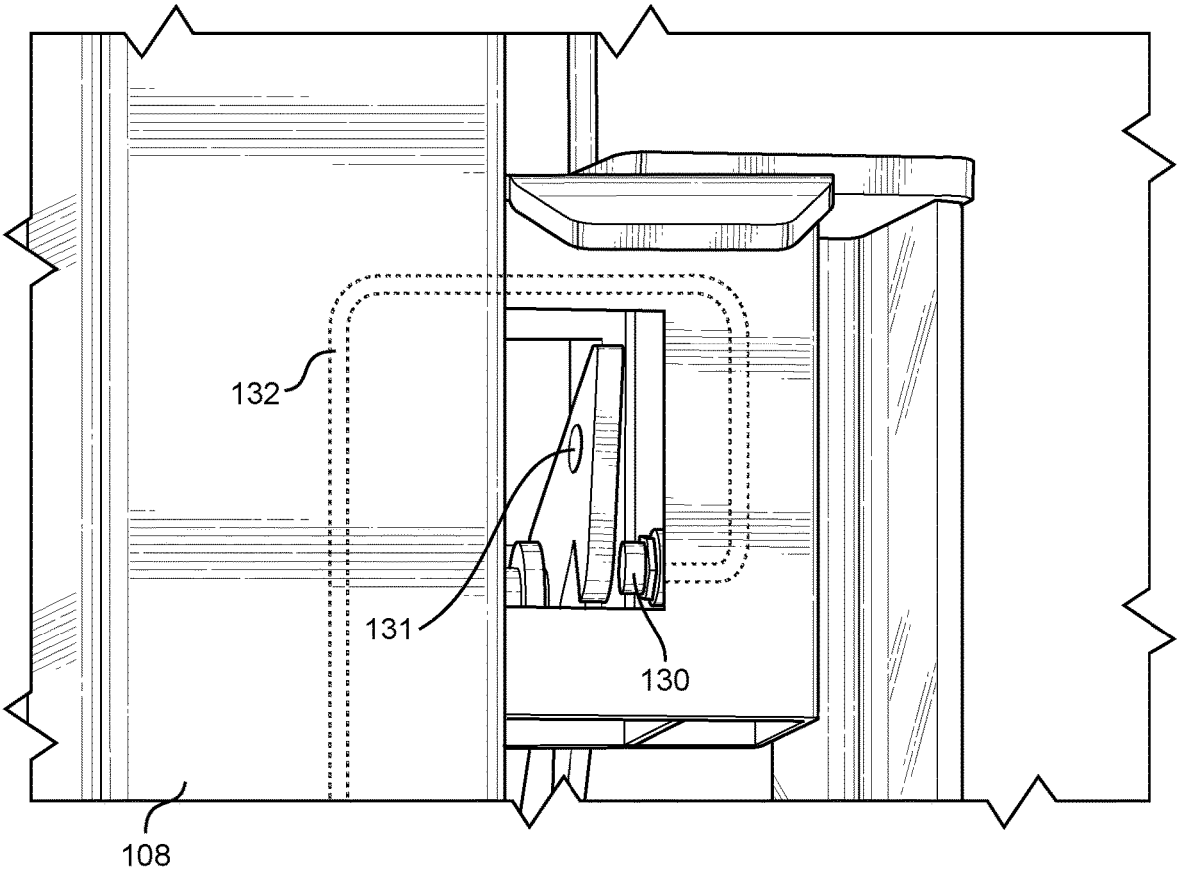
Figure 6B:
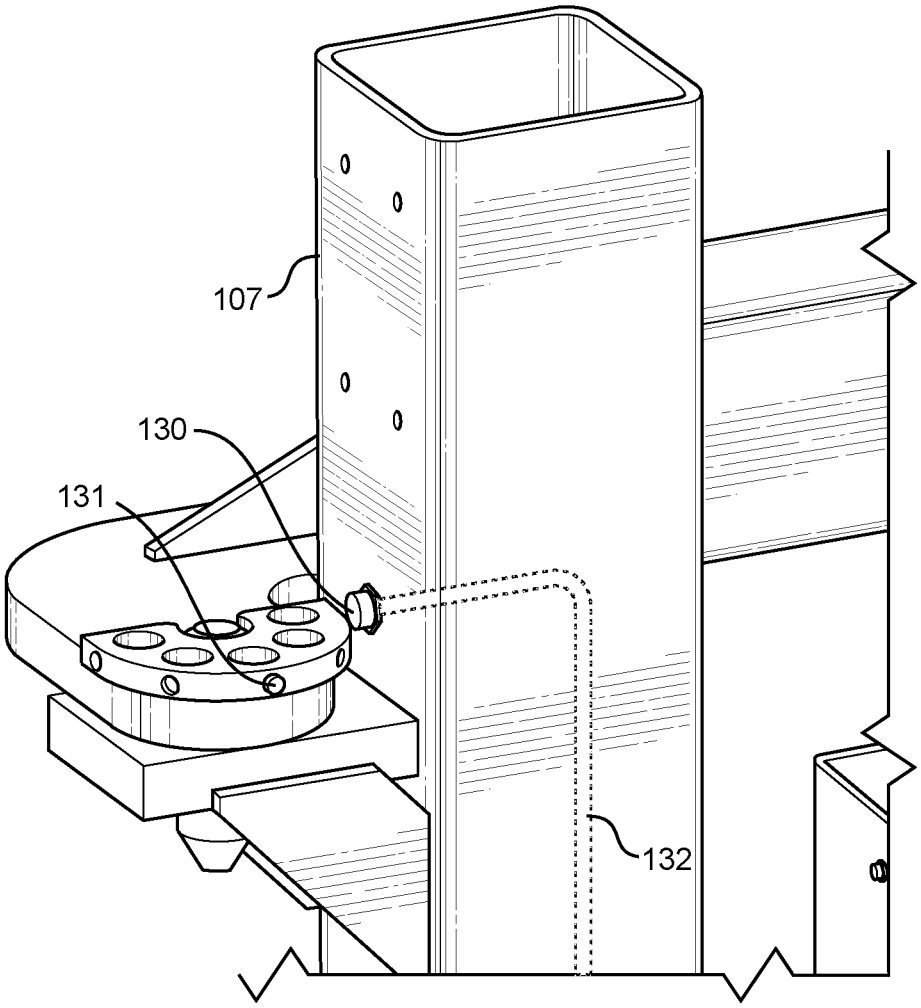

FIGS. 6*a* and 6*b* are partial perspective views of the gate safety barrier system with a gate interlock on the side of the latch bollard and the pivot bollard, respectively.

It should be understood that for clarity, not every part is labeled in every drawing. Lack of labeling should not be interpreted as a lack of disclosure.

DETAILED DESCRIPTION OF THE INVENTION

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

FIGS. 1*a* through 1*h* provide multiple views of an exemplary embodiment of a gate safety barrier 100. FIGS. 1*a* through 1*h* represent a gate safety barrier 100 comprised of a latch bollard 108 and a pivot bollard 107 with a horizontal center member assembly 106 pivotally attached to the pivot bollard 107. The center member 106 is comprised of left and right members 109 and 110 pivotally attached to each other with center hinge 115.

One advantage of gate safety barrier 100 is that it can pivot in a horizontal plane, therefore no counterbalance is needed to make the gate easy to open. If the gate pivoted in a vertical plane such as an up and down motion, some sort of counterbalance such as a spring or counterweight would be needed to operate the gate to overcome the heavy construction of the gate. The gate safety barrier 100 is robust because it has to withstand high kinetic energy from a forklift truck. In this gate safety barrier 100, by not needing a counterbalance, this reduces cost, simplifies design, and makes installation quick and easy. The structure of the gate safety barrier 100 is comprised of simple tubing and plates, easy to fabricate, weld, and assemble.

Since the gate safety barrier 100 pivots in a horizontal plane from the pivot bollard, it is hinged near its center at center hinge 115 to avoid taking up unnecessary space in front of a door opening 104. By having two sections (left and right members 109 and 110) instead of one long section pivoting on a bollard, horizontal center member assembly 106 essentially folds in half. The center hinge 115 attached to the left and right members 109 and 110 can be situated anywhere along the space between the ends. The center location is one potential arrangement. By having the center hinge 115 in the center location, the gate safety barrier 100 takes up the least amount of space when in the folded open position.

A dock floor 101 has a recessed pit 102. A dock leveler 103 is conventionally installed in the pit 102. The dock leveler 103 is shown in the stored cross-traffic position. It will be understood that at the door opening 104 which is cut into a wall 105, a dock leveler lip hangs pedant from the dock leveler 103.

In accordance with a first embodiment of this invention, the gate safety barrier 100 comprises pivot bollard 107 and latch bollard 108. The two bollards are upright, laterally spaced stationary support bollards positioned on opposite sides of passageway. They are anchored by suitable means (not shown) into the concrete floor 101. The gate safety barrier 100 further comprises the horizontal center member assembly 106 having two sections, left and right members 109 and 110, hinged together with center hinge 15 as shown is FIG. 1*e*. In one embodiment, center member assembly 106 also contains one covering 113 over center hinge 115. One end of the horizontal center member 109 is pivotally connected to pivot bollard 107 with hinge pins 111. The bollard on opposite side of passageway is latch bollard 108.

In the embodiment seen in FIGS. 1*d* and 2*a*, the hinge support brackets 116 on the pivot bollard 107 are moved 180 degrees away from the passageway about the pivot bollard 107 to the opposite side of the pivot bollard 107 facing the opening. The hinge support brackets 116 are at the opposite side of the pivot bollard 107 from the longitudinal axis A of the passageway. To orientate to the new support pivot location, the shape of the pin connection 117 on the end of the horizontal center member assembly 106 essentially wraps around the pivot bollard 107 in the open passageway configuration; as a result, the inner surface of the pin connection 117 conforms to the outer surface of the pivot bollard 107. This allows access to the full width of the passageway between the bollards 107 and 108 without the horizontal center member assembly 106 blocking any part of the passageway between bollards. In the embodiment shown, the pivot bollard 107 has a square cross-section so the pin connections 117 are changed to an L-shaped connection to mate up to the location of the hinge support brackets 116 on the pivot bollard 107.

As seen in FIG. 3*a*, when the horizontal center member assembly 106 starts to move from the closed blocked passage to the open unblocked passageway, the area around center hinge 115 expands to uncover said area. At this point of opening, the distance between left and right members 109 and 110 is too large to cause a pinch point. Conversely, as the horizontal center member assembly 106 is moved from an open unblocked passageway to a closed blocked passageway, the opening at the area around center hinge 115 contracts and creates a pinch point when left and right members 109 and 110 are in close proximity to one another. In various embodiments shown in FIGS. 3*b* through 3*e*, a covering 113 over the center section of horizontal center member assembly 106 at or in close proximity to center hinge 115 allows avoidance of a potential pinch point.

In the embodiment shown in FIG. 3*b*, covering 113 is a flexible type of material. Said material can be attached to or in close proximity to center hinge 115 by means of a connection that allows covering 113 to always cover the area around center hinge 115 on when horizontal center member assembly 106 moves from closed blocked passageway to open unblocked passageway and all positions in between. Other embodiments with a flexible covering 113 also include a means of attaching material to an additional area besides the area around center hinge 115 such as but not limited to left and/or right members 109 and 110 to keep the area around center hinge 115 covered from closed blocked passageway to open unblocked passageway and all positions in between.

In the embodiment shown in FIGS. 3*c* through 3*e*, the covering 113 is a metal cover consisting of multiple sections to cover the area around center hinge 115. Metal covering 113 consists of multiple sections to adjust and move with horizontal center member assembly 106 to maintain coverage of the area around center hinge 115 from closed blocked passageway to open unblocked passageway and all positions in between. The multiple sections will overlap one another so as not to causes a pinch point among the rigid sections themselves. The multiple sections of the covering 113 are affixed to the area around center hinge 115 by means of a pivoting and/or sliding connection. This connection will allow the multiple sections of the covering 113 to cover the area around center hinge 115 from closed blocked passageway to open unblocked passageway and all positions in between.

In another embodiment, a semi-rigid material is used for covering 113, wherein said material is rubber, brush, or plastic to cover the area around center hinge 115, similarly to the flexible material shown in FIG. 3*b*. This material is attached to one side of the horizontal center member assembly 106. As the horizontal center member assembly 106 is operated from an open unblocked passageway to a closed blocked passageway, the opening of the area around center hinge 115 contracts; the semi-rigid material of the covering 113 will then cover the opening to prevent a pinch point when the left and right members 109 and 110 are in close proximity to one another. If an operator's hands are in the area around center hinge 115, the semi rigid characteristics of the material will push away personnel's hands from said center hinge 115 without causing harm.

Another embodiment of gate safety barrier 100 shown in FIGS. 4*a* through 4*c* includes a detent 118 that automatically holds horizontal center member assembly 106 in desired position but yet will release if struck with fork-lift vehicle, causing no damage to the gate safety barrier 100. In the embodiment shown in FIGS. 4*a*-4*c*, the detent 118 is mounted on pivot bollard 107 and has a ball detent configuration, though detent 118 may have any detent configuration known in the art. A receiving plate 119 fixed to the pivot end of horizontal center member assembly 106 will contain at least one receiving feature 120. The exemplary embodiment includes multiple receiving features 120*a*, 120*b*, and 120*c*. The receiving feature 120 comprises any feature capable of receiving the detent 118, including, but not limited to, holes, notches, depressions, or slots. The configuration may also be reversed, with the detent 118 fixed to the pivot end of horizontal center member assembly 106 and the receiving plate 119 mounted on pivot bollard 107.

When the receiving plate 119 fixed to the pivot end of the horizontal center member assembly 106 rotates, the detent 118 enters the receiving feature 120*a* in the receiving plate 119, keeping the horizontal center member assembly 106 in a fixed position that maintains an unblocked passageway. To move the horizontal center member assembly 106 to another position or back to closed blocked passageway, the operator simply pushes/pulls the horizontal center member assembly 106 and the detent 118 will automatically dislodge from the receiving feature 120*a* in the receiving plate 119.

Another feature of the detent 118 is to keep the left and right members 109 and 110 parallel (in line) to one another when the horizontal center member assembly 106 is latched and in the closed blocked passageway position, as seen in FIGS. 4*b* and 4*c*. Gate latches typically have some tolerance and "play" built in so installation and alignment of the components of the gate safety barrier 100 does not have to be precise. This may allow the left and right members 109 and 110 of the horizontal center member assembly 106 not to be parallel (in line) to one another, as seen in FIG. 4*b*. By having another receiving feature 120*b* in the receiving plate 119 that allows the detent 118 to enter when the horizontal center member assembly 106 is latched and the left and right members 109 and 110 are parallel to one another will hold the horizontal center member assembly 106 in this position until the horizontal center member assembly 106 is unlatched and moved by operator. Additional receiving features 120*c* in the receiving plate 119 may be radially spaced from receiving features 120*a* and/or 120*b* allow the horizontal center member assembly 106 to be held in one or more partially open positions.

In another embodiment, a latch feature 112 holds the horizontal center member assembly 106 to the latch bollard 108 until a movement from operator to detach the horizontal center member assembly 106 from the latch bollard 108. Multiple embodiments of the latch feature 112 are possible.

In the first embodiment, the horizontal center member assembly 106 latches automatically when closed, without the need of the operator to perform a separate operation, and requires the operator to release it to open. This also ensures gate is always latched for improved safety. The operator guides the horizontal center member assembly 106 from the open unblocked passageway to the closed blocked passageway by means of the horizontal center member assembly 106 pivoting on pivot bollard which is on opposite side of passageway opening from the latch bollard. As shown in FIG. 5*a* through 5*c*, the operator guides the horizontal center member assembly 106 to the latch bollard 108, the latch end of the horizontal center member assembly 106 will engage the latch feature 112 on latch bollard 108. Upon fully extending the horizontal center member assembly 106 to the closed block passageway, at least one latch 121 will fully seat into at least one corresponding latch receiver 122 of the horizontal center member assembly 106. This completes the automatic latching feature of the gate safety barrier 100 without an additional operation needed to be done by operator. To unlatch the horizontal center member assembly 106, the operator must unlatch the latch 121 seated in the latch receiver 122 of the horizontal center member assembly 106 using a latch actuator 123 operably connected to the latch 121. The latch actuator 123 may be a type of mechanism such as, but not limited to, a lever, handle, linkage, and/or a combination thereof. This will disengage the latch 121 from the latch receiver 122 which will enable operator to move the horizontal center member assembly 106 to the open configuration unblocking the passageway.

In certain embodiments, as shown in FIGS. 5*d* through 5*f*, a latch release assembly 124 may be connected to at least one handle 114 used to open the gate safety barrier 100. The latch release assembly 124 may be comprised of at least one latch actuator 123 mounted or otherwise connected to the handle 114, at least one latch 121 mounted on the latch end of the horizontal center member assembly 106, at least one latch containment bracket 125 mounted on the latch end of horizontal center member assembly 106 over the latch 121, and at least one latch receiver 122 mounted on latch bollard 108.

In certain embodiments, the latch release assembly 124 also includes at least one actuator link 126 connecting the latch 121 and the latch actuator 123. The actuator link 126 may be, but is not limited to, at least one cable, rigid linkage, or combination thereof. This actuator link 126 allows increased distance between the latch 121 and the latch actuator 123.

With the latch release 124 near the handle 114 on the horizontal center member assembly 106, an operator can easily unlatch and then move the horizontal center member assembly 106. To unlatch the horizontal center member assembly 106, the operator actuates latch release 124 to unlatch the latch 121 seated in at least one latch receiver 122 of the latch bollard 108.

To operate the gate, the operator moves the latch actuator 123 which is in close proximity to the handle 114 on the horizontal center member assembly 106 to actuate the latch 121, potentially through the use of the actuator link 126. This action unlatches the horizontal center member assembly 106 from the latch receiver 122 mounted on latch bollard 108. With the operator's hand(s) still on the handle 114, the operator can pivotally move the horizontal center member assembly 106 from closed blocked passageway to open unblocked passageway.

Certain embodiments also include an interlock with system 100 for added safety. The interlock uses a magnetic switch 130 and magnet 131 for operation. In the exemplary embodiment, the switch 130 is a magnetic reed switch. There are two techniques that may be used to connect the interlock of the system 100 with various other types of dock equipment. Either technique may be used individually or both techniques may be used simultaneously within a single system 100.

The first technique utilizes an interlock with the latch side of the system 100. In this embodiment, the switch 130 is located in the latch receiver 122 and the majority of the associated interlock wiring 132 is contained inside the latch bollard 108 to protect the interlock wiring 132 from damage from material being moved and from motorized goods-handling devices. The magnet 131 is mounted in the latch 121. This setup on the latch side of the system 100 electrically communicates with another piece of dock equipment, indicating that the center member 106 at a specific position relative to the latch receiver 122.

In the exemplary embodiment of FIG. 6*a*, this position is a closed and latched position. The magnet 131 on the latch 121 when in the proper closed latched position will trigger switch 130 located precisely in the area to send an electrical signal to the other piece of dock equipment indicating that the center member 106 is indeed in the closed, latched position. A non-limiting example would be communicating with a truck restraint (not shown). The truck restraint would not be operable unless the center member 106 was in the closed, latched position. This would prevent the truck from leaving dock with the center member 106 in an open position, resulting in possible personnel injury and material damage.

The second technique utilizes an interlock on the pivot side of the system 100. The switch 130 is mounted on pivot bollard 107 and the associated interlock wiring 132 is again contained inside the pivot bollard 107. The magnet 131 is mounted to a portion of the center member 106. The magnet 131 is positioned on the center member 106 to trigger the switch 130 when the center member 106 is in a specific rotational position relative to the pivot bollard 107. This position may be fully open, fully closed, or partially open.

In the exemplary embodiment of FIG. 6*b*, the magnet 131 is mounted to the receiving plate 119. This exemplary interlock technique performs essentially the opposite of the first exemplary technique. Whereas the first technique tells if center member 106 is closed and latched, this interlock technique tells if the center member 106 is fully open. A non-limiting example would be communicating with dock leveler 103. The dock leveler 103 would not be able to operate unless the center member 106 is in the fully open position. This prevents the dock leveler 103 from raising and contacting the center member 106 if the center member 106 is in the area over the dock leveler 103, preventing damage to the dock leveler 103 and center member 106.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

We claim:

1. A gate safety barrier system, comprising:

a pivot bollard positioned on a side of a passageway opposite a latch bollard, wherein a center member assembly is pivotally mounted to the pivot bollard such that the center member assembly is selectively movable between a closed configuration blocking the passageway and an open configuration unblocking the passageway, the center member assembly pivotally mounted to the pivot bollard by at least one hinge pin extending through at least one hinge support bracket and at least one pin connection such that rotation of the center member assembly relative to the pivot bollard is in a horizontal plane, wherein the at least one hinge support bracket is connected to the pivot bollard on a side of the pivot bollard opposite the passageway at a −180-degree angle to a longitudinal axis of the passageway and the at least one pin connection is connected to the center member assembly, wherein the center member assembly comprises a left member pivotally connected to a right member with a center hinge such that rotation of the left member relative to the right member is in a horizontal plane.

2. The system of claim 1, wherein the inner surface of the at least one pin connection conforms to an outer surface of the pivot bollard.

3. The system of claim 1, wherein the inner surface of the at least one pin connection has an L-shaped configuration.

4. The system of claim 1, further comprising a covering which covers the center hinge.

5. The system of claim 4, wherein the covering also covers at least part of the left member and at least part of the right member around the center hinge.

6. The system of claim 4, wherein the covering comprises a flexible material attached to at least one of the center hinge, the left member, or the right member.

7. The system of claim 4, wherein the covering comprises multiple sections of a metallic material.

8. The system of claim 4, wherein the covering comprises a semi-rigid material fastened to at least one of the left member or the right member.

9. The system of claim 1, further comprising at least one latch connected to the latch bollard and at least one corresponding latch receiver connected to the center member assembly, wherein the at least one latch will fully seat into the at least one corresponding latch receiver when the center member assembly is moved to the closed configuration blocking the passageway.

10. The system of claim 9, further comprising at least one latch actuator operably connected to the latch, wherein actuation of the at least one latch actuator disengages the at least one latch from the at least one corresponding latch receiver.

11. The system of claim 1, further comprising at least one latch connected to the center member assembly and at least one corresponding latch receiver connected to the latch bollard.

12. The system of claim 11, further comprising at least one latch actuator operably connected to the latch, wherein actuation of the at least one latch actuator disengages the at least one latch from the at least one corresponding latch receiver.

13. The system of claim 12, wherein the at least one latch actuator is connected to at least one handle, wherein the at least one handle is connected to the horizontal center member assembly.

14. The system of claim 11, further comprising at least one latch containment bracket is mounted on the horizontal center member assembly over the at least one latch.

15. The system of claim 11, further comprising at least one actuator link connecting the at least one latch and the at least one latch actuator.

16. The system of claim 1, further comprising one of a detent and a receiving plate mounted on the pivot bollard and the other of the detent and the receiving plate fixed to the horizontal center member assembly, the receiving plate having at least one receiving feature capable of receiving the detent.

17. The system of claim 16, wherein the at least one receiving feature is located on the receiving plate such that when the detent is located within the receiving feature, the horizontal center member assembly is in at least one configuration selected from: a closed configuration blocking the passageway, an open configuration unblocking the passageway, or a partially open configuration located between the closed configuration and the open configuration.

18. The system of claim 16, wherein the detent has a ball detent configuration.

19. The system of claim 1, further comprising an interlock having a switch located in a latch receiver and a magnet is mounted in a latch, wherein the magnet is positioned on the latch to trigger the switch when the latch is in a specific position relative to the latch receiver.

20. The system of claim 1, further comprising an interlock having a switch mounted on the pivot bollard and a magnet mounted to the horizontal center member assembly, wherein the magnet is positioned on the horizontal center member assembly to trigger the switch when the horizontal center member assembly is in a specific rotational position relative to the pivot bollard.

* * * * *